United States Patent [19]

Pennington et al.

[11] 3,999,607

[45] Dec. 28, 1976

[54] RECOVERY OF HYDROCARBONS FROM COAL

[75] Inventors: Robert E. Pennington, Baytown; Michael A. Gibson, Houston; George T. Arnold, Baytown, all of Tex.

[73] Assignee: Exxon Research and Engineering Company, Linden, N.J.

[22] Filed: Jan. 22, 1976

[21] Appl. No.: 651,661

[52] U.S. Cl. ..... 166/259; 48/DIG. 6; 166/260; 166/261; 166/263; 166/266

[51] Int. Cl.[2] ..... E21B 43/24; E21B 43/26

[58] Field of Search ..... 166/259, 260, 261, 263, 166/266, 271, 299, 308; 299/2, 6; 48/DIG. 6

[56] References Cited

UNITED STATES PATENTS

| | | | |
|---|---|---|---|
| 947,608 | 1/1910 | Betts | 299/6 X |
| 1,913,395 | 6/1933 | Karrick | 299/6 X |
| 2,595,979 | 5/1952 | Pevere et al. | 166/303 |
| 3,001,775 | 9/1961 | Allred | 166/259 X |
| 3,010,707 | 11/1961 | Craighead et al. | 166/259 |
| 3,223,158 | 12/1965 | Baker | 166/259 |
| 3,233,668 | 2/1966 | Hamilton et al. | 166/259 |
| 3,465,819 | 9/1969 | Dixon | 166/247 |
| 3,616,855 | 11/1971 | Colgate et al. | 166/308 X |
| 3,734,184 | 5/1973 | Scott | 166/259 |
| 3,924,680 | 12/1975 | Terry | 166/259 X |

OTHER PUBLICATIONS

Elder, The Underground Gasification of Coal, *Chemistry of Coal Utilization*, Supplementary Volume, Ed. by H. H. Lowry, N.Y. John Wiley & Sons, Inc. 1963, CH. 21, pp. 1023–1040.

Stephens, *Prospects for In Situ Coal Liquefaction*, UCRL–51770, Lawrence Livermore Laboratory, University of California at Livermore, May 7, 1975, pp. 1–17.

*Primary Examiner*—James A. Leppink
*Assistant Examiner*—George A. Suchfield
*Attorney, Agent, or Firm*—James E. Reed

[57] ABSTRACT

Coal liquids and gases are recovered from a thick underground coal seam by drilling one or more boreholes from the earth's surface into the lower part of the seam, burning out the coal over a limited area near the bottom of the seam, collapsing the overlying coal to form a rubblized zone extending vertically to a point near the upper boundary of the seam, driving a flame front vertically through the rubblized zone to liberate hydrocarbon liquids and produce gases, and recovering the liquids and gases from the rubblized zone.

33 Claims, 5 Drawing Figures

RECOVERY OF HYDROCARBONS FROM COAL

BACKGROUND OF THE INVENTION

1. Field of the Invention

This invention relates to the recovery of liquid hydrocarbons from coal and is particularly concerned with an improved in situ recovery process which permits the recovery of hydrocarbon liquids in substantial quantities.

2. Description of the Prior Art

Considerable work on the underground gasification of coal has been done in the past, particularly in the Soviet Union, Great Britain, Belgium, France, Italy and the United States. The early work for the most part was directed toward the injection of air into underground passageways produced by mining operations to permit the recovery of combustible gases containing substantial quantities of hydrogen and carbon monoxide. To improve contact between the injected gas and the coal, it was proposed that coal be broken down from the walls by cutting, drilling and shooting operations and that suitable barriers be introduced within the headings or tunnels to force the gases to move through the loosely piled coal. The use of stoping, where applicable, has also been proposed as a means for providing broken coal through which the gases may be passed. The most successful operations of this type have been those carried out in steeply tilted formations where air is injected from the earth's surface through a first tunnel extending downdip in the seam, combustion takes place in a second, horizontal tunnel extending along the strike, and the combustion products are withdrawn through a third tunnel extending updip to the earth's surface. Combustion takes place along the roof of the horizontal tunnel and hence the ash and any collapsible rock fall into the bottom of the tunnel. This permits the movement of air along the face of the coal as the combustion front moves upwardly in the seam and avoids blockage of the passageways. This method is reportedly still used in the Soviet Union but has limited application because of the requirement that the coal seam be steeply tilted.

Because of the high cost of underground mining operations, there have been numerous attempts to carry out underground gasification between boreholes drilled into coal seams from the earth's surface. Coal normally has some permeability and when heated tends to shrink, crack and become more permeable. In general, however, this permeability is not sufficient to permit effective gasification between boreholes and hence some method for providing an initial passageway between the boreholes must be employed. An early proposal suggested the injection of air through a central pipe string in each of two boreholes and the recovery of combustion gases through the annulus surrounding each pipe string until a cavity had been burned out at the bottom of each hole and communication between the holes had been established. Thereafter, one borehole was used for the injection of air and the other was employed for the recovery of combustion products. Other methods which have been proposed include the use of hydraulic or pneumatic pressure to fracture the coal between boreholes, the use of electrodes between which an electric current can be passed to carbonize the coal and create a permeable channel, the use of explosives to shatter the coal between boreholes, the use of nuclear devices to create shattered zones of high permeability, the use of directional drilling to establish underground passageways between boreholes spaced some distance apart at the earth's surface, and the injection of acids or other chemicals into the coal seam to react with the coal and create zones of relatively high permeability through which gases can be subsequently passed. All of these methods are intended to permit the injection of air or oxygen, alone or in combination with steam, into the coal seam and the recovery of gases containing hydrogen and carbon monoxide in relatively high concentrations. These gases have relatively low Btu contents but can be treated for the removal of carbon dioxide and sulfur and nitrogen compounds and then employed as low grade fuel gases or upgraded by conventional methanation operations carried out at the surface. They can also be further processed for the recovery of hydrogen or for use as feedstocks to Fischer-Tropsch or similar processes.

Comparatively little work has been done on in situ processes for the recovery of liquids from coal. It has been observed that the gases produced during underground gasification operations may contain tars and some low molecular weight hydrocarbons. There have been suggestions that hydrogen and various aromatic hydrocarbons might be injected into underground seams at high temperatures and pressures to hydrogenate a portion of the coal and permit the recovery of liquid products. It has been proposed that nuclear explosives be detonated in oil shales and other formations to create cavities and permit the recovery of vaporized or liquefied hydrocarbons. In general, however, these suggestions have been speculative in nature. No process of this type which appears commercially feasible has yet been developed.

SUMMARY OF THE INVENTION

The present invention provides an improved in situ process which permits the recovery of liquids from thick underground coal seams in substantial quantities and has numerous advantages over processes proposed in the past. In accordance with the invention, it has now been found that coal liquids and gases can be recovered from such a seam by drilling one or more boreholes from the earth's surface into the lower part of the seam, burning out the coal over a limited area near the bottom of the seam, collapsing the overlying coal to form a rubblized zone extending vertically to a point near the upper boundary of the seam, driving a flame front vertically, preferably downwardly, through the rubblized zone to liberate hydrocarbon liquids and produce gases, and recovering the liquids and gases from the rubblized zone. This process permits the economical recovery of high grade coal liquids in substantial quantities, makes possible the concurrent or subsequent gasification of coal solids formed during the liquids recovery operation, and avoids many of the difficulties which have characterized in situ processes for the recovery of hydrocarbons and other materials from coal in the past.

DESCRIPTION OF THE PREFERRED EMBODIMENTS

Figure 2:
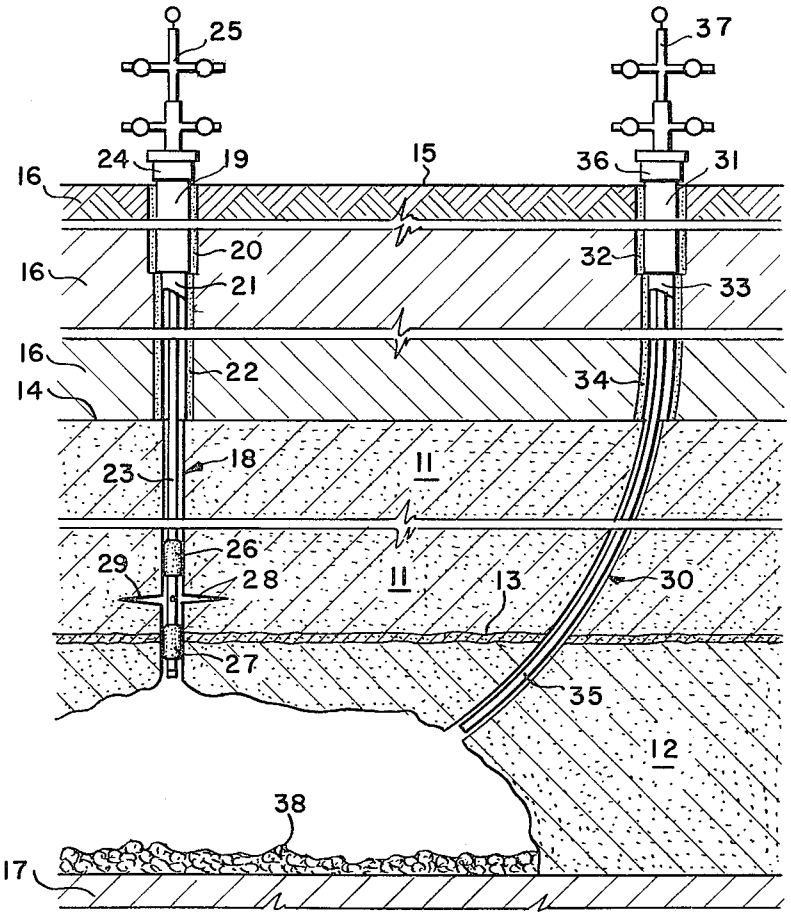
FIG. 2 is a drawing illustrating the coal seam and overlying formations of FIG. 1 during a later stage of the process.

The process of this invention is applicable to bituminous coals, subbituminous coals, lignites and the like and may be carried out in seams of various thicknesses, depths and orientations. It is particularly advantageous, however, in deep, relatively thick seams or closely spaced multiple seams which are separated by relatively thin layers of slate, shale, sandstone or the like and are located at depths which normally preclude economical recovery of the coal by surface or conventional deep mining operations. Particularly suitable candidates for the process are seams or groups of seams which range from about 50 to about 1000 feet or more in thickness and lie at depths of from a few hundred to several thousand feet below the earth's surface. Studies indicate that there are a large number of such seams and that many of these cannot be economically mined by conventional methods. Relatively non-caking coals which have low plastic properties as measured by their Free Swelling Index values and other tests are ordinarily preferred candidates but the process is not restricted to these coals.

Caking coals differ from the noncaking coals in that they tend to become plastic at the elevated temperatures required for liquids recovery and on further heating harden to form coherent masses of low permeability and porosity that may seriously interfere with recovery operations. This difficulty can be alleviated by treating the coal with a solution of an alkali metal or alkaline earth metal compound as described hereafter. These compounds react with the coal as it is heated and greatly reduce its tendency to cake or agglomerate. In addition, such compounds act as gasification catalysts and have other advantages. They may therefore be used with both caking and noncaking coals.

A variety of different alkali metal and alkaline earth metal compounds can be used for treating coals in which the process of the invention is to be carried out. In general, alkali metal compounds such as the alkali metal carbonates, bicarbonates, formates, biphosphates, oxolates, aluminates, amides, hydroxides, acetates, sulfates, hydrosulfates, tungstates, sulfides and the like are preferred. All of these are not equally effective for purposes of the invention and hence certain compounds may give somewhat better results than can be obtained with others. The cesium compounds, particularly salts derived from organic or inorganic acids having ionization constants less than $1 \times 10^{-3}$ and the hydroxide, are generally the most effective, followed by the potassium, sodium and lithium compounds in that order. For economic reasons, however, the potassium compounds are generally employed.

The alkali metal or alkaline earth metal compounds are generally used to alleviate the caking tendencies of coals which might otherwise present difficulties during operation of the process by treating the coal with an aqueous solution of the alkali metal or alkaline earth metal compound selected. This can be done at the onset of the recovery operation, following the drilling of one or more boreholes into the coal seam, but will ordinarily be done after a cavity has been burned out at the bottom of the coal seam and the overlying coal has been broken down to form a rubblized zone extending vertically over substantially the entire seam. It is generally preferred to introduce the solution containing the alkali metal or alkaline earth metal compound into the coal seam or rubblized zone in a quantity sufficient to provide from about 0.1 to about 20% of the compound by weight, based on the amount of coal present. This treating of the coals will be described in greater detail hereafter.

Figure 1:
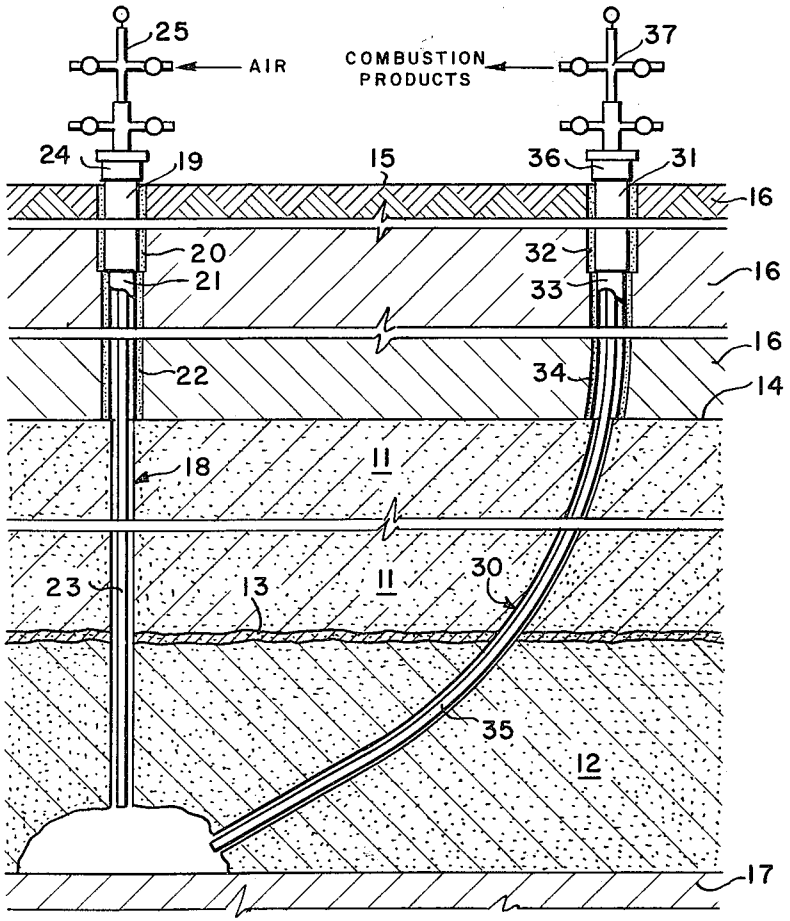
FIG. 1 in the drawing is a schematic diagram showing a vertical cross-section through an underground coal seam and the overlying formations during an early stage of an operation for the recovery of liquids from coal carried out in accordance with the invention.

The geological section depicted in FIG. 1 of the drawing is one in which a relatively thick seam of noncaking coal 11 and a somewhat thinner seam of similar coal 12 are separated by a thin barrier of slate 13 to give a total coal thickness of about 200 feet. The upper boundary of the upper seam 11 lies at a depth of about 1000 feet below the earth's surface 15 and is overlain by sandstones and other formations 16, some of which may be aquifers. Below the lowermost of the two seams are relatively impermeable formations 17. Although the section depicted is one which is particularly well suited for carrying out the process, it will be understood that the invention is not restricted to such a section and is applicable to any of a variety of other coal deposits.

In carrying out the process of the invention, a vertical borehole 18 is first drilled from the earth's surface into the lower part of the coal seam by conventional methods. This borehole will normally be equipped with a string of large diameter casing or surface pipe 19 which extends to a depth below any aquifers near the surface and thus serves, among other things, to prevent the contamination of surface water supplies. The surface pipe is cemented in place in the conventional manner as indicated by reference numeral 20. Extending downwardly through the surface pipe is an intermediate string of casing 21 which is also cemented in place, the cement being designated by reference numeral 22. In the installation shown in FIG. 1, this intermediate casing string extends to the top 14 of coal seam 11. An inner pipe or tubing string 23 extends downwardly through the outer and intermediate casing strings to a point near the bottom of the borehole. The casing hangers and other equipment used to suspend the pipe within the hole do not appear in the drawing. The actual casing arrangement within the borehole will depend in part upon the depth of the coal seam, the nature of the overlying strata, the manner in which the in situ operation is to be carried out, and the like and may be varied as necessary. A conventional wellhead 24 and Christmas tree 25 fitted with a plurality of lines and valves through which fluids may be injected or produced from the central pipe or tubing string and the annular passages surrounding it has been installed as shown in the drawing. The particular type of wellhead and Christmas tree employed will normally depend in part upon the casing within the borehole and the manner in which the particular operation is to be conducted. Equipment normally used in the petroleum industry will ordinarily be suitable.

The process of the invention may be initiated with a single borehole or with two or more boreholes. In the operation shown in FIG. 1, an initial borehole 18 has been drilled and cased as described above and a second borehole 30 has later been drilled from an offset location on the earth's surface to a point near the lower end of borehole 18. Directional drilling methods and borehole surveying techniques similar to those employed in the petroleum industry may be used for controlling the location of the lower end of the second borehole. This second borehole is equipped with surface pipe 31 which is cemented in place as indicated by reference numeral 32, with an intermediate casing string 33 surrounded by cement 34 extending to the top of coal seam 11, and with a central tubing string 35 which extends downwardly through the surface pipe and intermediate casing string to a point near the bottom of coal seam 12. In some cases it may be advantageous to extend the intermediate casing string into the coal zone and cement it in place within the coal to help protect the pipe during later operations. A wellhead 36 and Christmas tree 37, which may be similar to those used with borehole 18, have been installed. Again it will be understood that the process is not restricted to the particular borehole arrangement depicted in FIG. 1 and that other arrangements may be employed.

Following the drilling of one or more boreholes into the lower part of the coal seam as described above, combustion is initiated to burn out a cavity near the bottom of the seam. This may be done in any of several different ways. Where a single borehole is used, for example, combustion may be started near the bottom of the seam by injecting a small quantity of a liquid fuel such as heavy naphtha or kerosene into the bottom of the borehole, circulating air to the bottom of the hole through the central tubing string and back to the surface through the surrounding annulus, and then actuating an electrical igniter lowered into the bottom of the hole through the tubing string while continuing the flow of air. An alternate procedure is to introduce hypergolic components, highly unsaturated hydrocarbons and fuming nitric acid or other strong oxidizing agents, for example, into the borehole separately and allow them to contact and react with one another at the bottom of the hole. Another procedure which may be used is to circulate oxygen into the bottom of the hole until combustion takes place spontaneously. Still other ignition procedures which can be employed will suggest themselves to those skilled in the art. Where two boreholes are used as illustrated in FIG. 1, combustion can be initiated in each of the boreholes by any of the methods mentioned above and continued by injecting air into and withdrawing combustion products from each borehole until communication between the holes has been established. Alternatively, communication can be established prior to the initiation of combustion by injecting air or gas into one borehole under sufficiently high pressure to fracture the coal between the two holes, by hydraulic fracturing between the boreholes, by detonating directional or other explosive charges in one or both boreholes, by lowering electrodes into both holes and passing a current between them to carbonize the coal, or by other conventional means. Once this has been done, combustion can then be started as described above and continued by injecting air or oxygen into one of the boreholes and withdrawing combustion products from the other.

After combustion has been initiated, which can be determined by monitoring the temperature and composition of the gases withdrawn from the coal seam or by means of thermocouples or the like, air, oxygen-enriched air, or oxygen is injected through the tubing string of one borehole and combustion products are withdrawn through the tubing string of the other, or through the casing annulus in the same borehole if only one borehole is used, to sustain combustion. Steam may also be injected to aid in controlling combustion if desired. It is normally preferred to employ two boreholes and to inject air or other oxygen-containing gas through tubing string 23 in borehole 18 while withdrawing combustion products through tubing string 35 in borehole 30. This generally promotes movement of the combustion zone laterally from borehole 18 and tends to limit vertical movement of the combustion zone. To avoid undue damage to the central tubing string 35 in borehole 30 as a result of the high combustion temperatures generated, the tubing string can be removed from the vicinity of the burning coal by raising the tubing from the surface. Water can also be injected in limited quantities down the annulus of one or both boreholes to cool the tubing and prevent serious damage. The water thus injected will be vaporized and ultimately withdrawn in part as steam with the combustion gases. Insulation can also be employed in some cases to aid in protecting the tubing. The combustion gases produced during this phase of the operation will normally have a high carbon monoxide-to-carbon dioxide ratio and can be used as a fuel for driving the air compressors at the surface or other purposes. Hydrogen produced from water or steam present in the system will contribute to the heating value of the gases generated.

The initial combustion operation described in the preceding paragraph is continued until a substantial volume of coal has been burned out near the botton of the seam as illustrated in FIG. 2 of the drawing. The volume of the cavity thus formed which will be required in a particular operation will depend in part upon the height and depth of the coal seam, the number and thickness of the shale breaks, slate, or other noncombustible zones, if any, within the coal body, the character of the overburden, the composition of the coal itself, and the like. In general, it is preferred to burn out a cavity at the bottom of the seam equivalent to from about 5 to about 30% of the volume of the coal overlying an area of from about one-fourth to about two acres in the vicinity of the injection borehole. In deep, thick seams, a somewhat larger volume may be burned out than would normally be burned out in a relatively shallow, thin seam. In a deep seam having a thickness of about 200 feet, for example, a cavity which has a radius of about 100 feet and thus corresponds to a surface area of about three-fourths of an acre surrounding the injection well will normally be adequate. In a thicker formation, a cavity of somewhat larger size may be preferable. The approximate dimensions of the cavity formed can be determined by recording the volume and composition of the injected and produced gases, calculating the volume of coal consumed in the combustion operation, and then measuring the distance from the surface to the combustion zone in the injection well. Other methods which may be used to determine the cavity volume include techniques based on pressure behavior following the shutoff of gas flow at the production or injection well, and the like.

The formation of the cavity at the bottom of the coal seam has been described above primarily in terms of combustion of the coal but other phenomena will also take place. The presence of steam in the vicinity of the high temperature combustion zone, due to vaporization of water present in the coal or injected steam or water, will result in some gasification of the coal and the formation of hydrogen and additional carbon monoxide. Other gasificareactions may also tend to occur. As indicated earlier, these reactions can be promoted by injecting a solution of potassium carbonate or a similar water-soluble alkali metal or alkaline earth metal compound into the coal at the bottom of the borehole prior to the initiation of combustion or during the combustion operation. The use of such a compound tends to accelerate gasification and combustion of the carbon and thus permits the development of a cavity of the requisite size more quickly than might otherwise be the case. The use of potassium carbonate is generally preferred but other alkali metal or alkaline earth metal compounds can also be used.

After a cavity of the desired volume has been generated in the manner described above, the injection of combustion air or other oxygen-containing gas into the seam through injection borehole 18 is terminated. Thereafter, the coal overlying the cavity is broken down to form a rubblized zone of high permeability extending vertically over substantially the entire extend of the seam. This may be done by hydraulic or pneumatic fracturing, by explosive fracturing, or the detonation of explosive charges in one or both of the boreholes or by other methods. If hydraulic or pneumatic fracturing is to be employed, the tubing string 23 can be withdrawn from the borehole 18, fitted with packers 26 and 27 and with a valve or closure at its lower end, and then run back into the hole. Depending upon the particular type of packer employed, the packers may be set either mechanically or hydraulically. This effects a seal between the outer surface of the tubing string and the surrounding wall of the borehole at each packer. Once this has been done, a perforating tool is lowered through the tubing string into position between the packers. The tool may be of either the shaped charge or bullet type. This tool can then be fired to create perforations in the tubing between the packers and penetrate the adjacent coal faces as indicated by reference numerals 28 and 29. Other packer and tubing arrangements, some of which may not require perforation of the tubing string, can also be employed. After the perforations have been formed, the coal can be broken down by injecting air or inert gas or a hydraulic or explosive fracturing fluid through the tubing string and perforations into the annular space between the packers and the surrounding coal. If desired, a similar perforating and fracturing operation can be carried out in borehole 30 to assist in breaking down the coal so that it will fall onto the ash and other solids 38 on the floor of the cavity below. Any stringers of slate or other material embedded in the coal, such as slate layer 13, will be broken down with the coal. The presence of such material is often advantageous in that it later serves to break up flow patterns within the rubblized zone and thus discourage channeling. The perforating and fracturing operation may be carried out as many times as necessary until the coal below upper boundary 14 has been broken down and a rubblized zone extending over substantially the entire extent of the seam has thus been formed around the borehole, or if two boreholes are used, between the boreholes.

In lieu of breaking down the coal by fracturing as described above, coal can also be broken down by pulling the tubing string 23 out of the hole, lowering a series of shaped explosive charges into the open borehole below intermediate casing string 21, and then detonating the shaped charges in sequence. Nondirectional charges can also be detonated in the open borehole to break down the coal if desired. Here again, the breaking down operation can be carried out in both borehole 18 and borehole 30 to increase the amount of coal broken down and thus increase the size of the resulting rubblized zone if desired. If necessary, combustion operations can be resumed between break down operations in order to enlarge the cavity and aid in creation of the rubblized zone.

Other methods which can be employed to break down the coal and any interbedded slate or other material, particularly in very thick, deep formations, include the use of deviation tools to drill one or more deviated holes from borehole 18 into the coal above the cavity. If this procedure is used, the deviated holes will normally be drilled after borehole 18 is drilled to the bottom of the coal seam and before the cavity is burned out. After the cavity has been formed, explosive charges can then be detonated within the deviated hole or holes in order to break down the coal into the underlying cavity and create the rubblized zone. Still another procedure which may be employed is to use two or more vertical boreholes in lieu of one vertical hole and one deviated hole as shown in the drawing. Communication between the holes at the bottom of the coal seam can be established initially be electrocarbonization of the coal, fracturing, or the like, and thereafter the cavity can be burned out in much the same manner as is described above. Once this has been done, hydraulic fracturing, explosive fracturing, or other means can be utilized to break down the overlying coal into the cavity and thus form the rubblized zone. If explosives are used, the velocity of the explosives chosen can be selected to control to some extent the amount of shattering of the coal which takes place. The use of relatively slow burning explosives is often advantageous because such explosives tend to break the coal down in relatively large fragments over substantial areas.

If the coal in which the liquids recovery operation is to be carried out is a caking coal, the coal can be treated at this point with an alkali metal or alkaline earth metal compound to alleviate difficulties due to caking as pointed out earlier. This will normally be done by injecting water containing dissolved potassium carbonate or the like into the rubblized zone through borehole 18 or 30 until from about 0.1 to about 20%, preferably from about 0.5 to about 5%, of potassium carbonate or the like, based on the weight of the coal within the zone, has been introduced. The injected solution will flow through the interstices between the coal particles and at least in part be imbibed or impregnated into the coal. The presence of the potassium carbonate or similar compound will reduce the caking tendency and permit carrying out of the operation in substantially the same manner as if the coal were noncaking.

Figure 3:
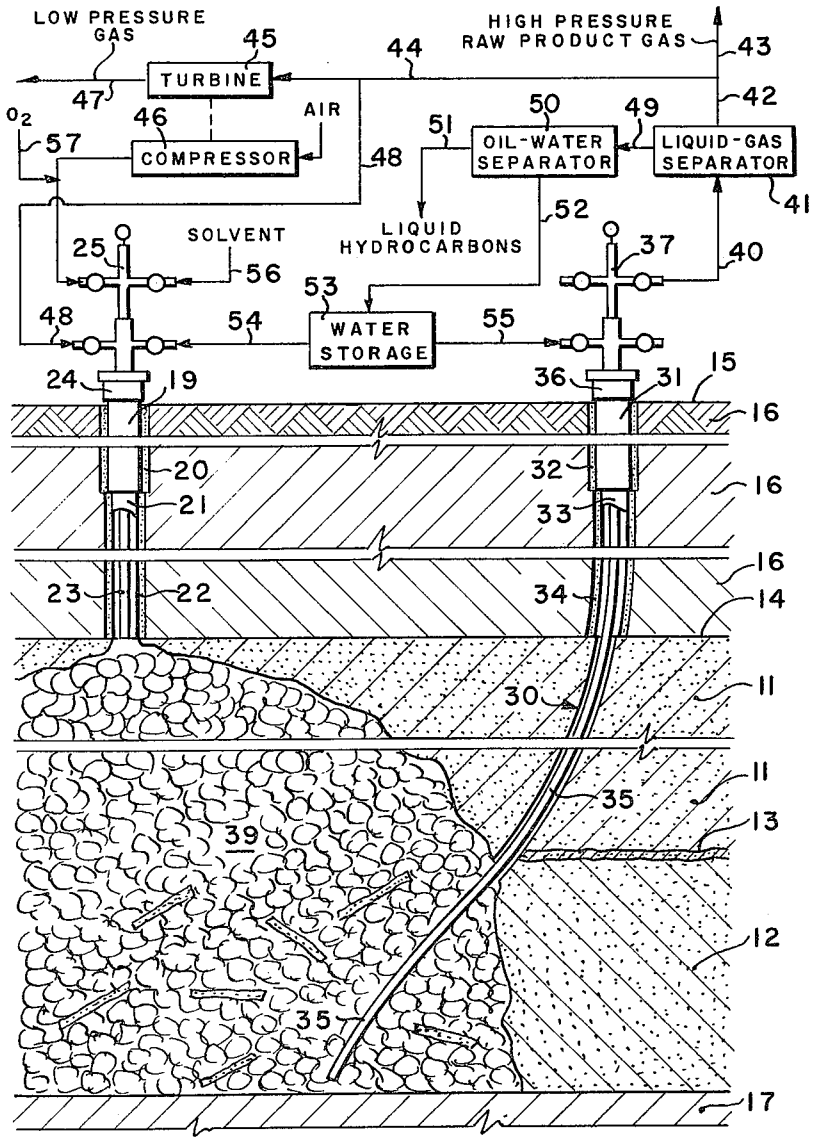
FIG. 3 is a drawing showing the seam and overlying formations of FIGS. 1 and 2 and associated surface facilities during a still later stage of the process.

FIG. 3 in the drawing illustrates the coal seam and overlying formations of FIGS. 1 and 2 after the coal has been broken down into the burned out cavity and the rubblized zone has been formed as described above. It will be noted that the zone extends vertically over substantially the entire depth of the coal in the vicinity of borehole 18. Tubing 23 has been lowered into the borehole to a point near the top of the rubblized zone and connected into the Christmas tree to permit the injection of air or other oxygen-containing gas through it. Borehole 30 has been redrilled to the bottom of the rubblized zone and tubing string 35 has been run into the hole to a point near the bottom and connected to the Christmas tree 37 to permit the production of fluids from the rubblized zone to the surface. Surface facilities for use in the liquids recovery operation have been provided.

Following establishment of the rubblized zone, air or oxygen is injected through tubing string 23 and the coal at the top of the zone is ignited. This may be done by using a liquid or gaseous fuel and an electrical igniter in a manner similar to that described earlier or by means of a hypergolic mixture or the like. Since the solids in the rubblized zone 39 will retain much of the heat liberated during the burning out of the cavity, the temperature within the zone may be considerably above the normal coal seam temperature and ignition may take place spontaneously upon the introduction of air or oxygen through the tubing string into the zone. It is generally preferred to employ oxygen or oxygen-enriched air for establishing combustion initially. Laboratory work has shown that a front temperature in excess of about 1000° F., preferably on the order of 1500° to 1800° F., should normally be maintained. If the initial combustion temperature is not sufficiently high, tests have shown that part of the injected oxygen may tend to bypass the initial combustion zone and move downstream of it, resulting in the consumption of volatilized hydrocarbons which would otherwise be displaced by combustion products and thus be available for recovery from the process. By employing oxygen or oxygen-enriched air to start combustion at the upper end of the rubblized zone, a sufficiently high initial combustion temperature can be obtained to avoid this and ensure the establishment of a suitable flame front.

After combustion has been established, the oxygen content of the injected gas can generally be reduced to a lower level such as that of air if desired. Once combustion has been started and a flame front has been established, the air rate is adjusted to cause the front to move downwardly through the rubblized zone. Experiments have demonstrated that the rate of advance of the front can be readily controlled. At low injection rates, combustible materials tend to diffuse backwardly into the zone containing oxygen so that the flame front may tend to move in a direction opposite to that in which the injected gases flow. At higher rates, this diffusion does not occur to any significant extent and hence the flame front moves forward with the injected gases. The air rate required for optimum performance in a particular operation will depend in part upon the size and physical characteristics of the rubblized zone, the composition of the coal within the zone, the composition of the injected gas stream, the moisture content of the coal within the zone, and other factors. By monitoring the produced fluids and observing temperatures at the injection and production boreholes, the rate can normally be adjusted to secure satisfactory movement of the flame front without difficulty. By maintaining suitable back pressure at the production borehole, the pressure within the rubblized zone can be controlled. As will be pointed out hereafter, it will often be advantageous to operate at elevated pressures of from 100 to 1000 psi or higher.

As the flame front advances downwardly through the rubblized zone, hydrocarbons in the coal in advance of the flame front are volatilized and displaced by the products of combustion. These hydrocarbons move downwardly within the rubblized zone and in part condense in the lower portion of the zone. After the combustion front has been established for a substantial period of time, liquid hydrocarbons will begin to accumulate in the lower part of the zone and be produced along with combustion gases through the tubing string 35 in wellbore 30. Alternatively, the liquids can be withdrawn through the tubing string and the gases can be taken off through the surrounding annulus. A pump, not shown, can be installed to aid in recovery of the liquids if necessary. The liquids, condensable vapors and gases thus conducted to the surface are withdrawn from the Christmas tree 37. If necessary, water may be injected down the borehole surrounding the tubing string 35 in order to cool the tubing and prevent excessive damage to it. This injection of air and production of gases, vapors and liquids is continued until the combustion front reaches a point near the bottom of the rubblized zone, as indicated by a marked reduction in the quantity of liquids produced.

It is normally preferred to initiate combustion at the top of the rubblized zone and drive the flame front downwardly through the zone as described above but in some cases it may be advantageous to move the front in the opposite direction or to alternate the direction in which the front moves. In most instances movement of the front downwardly through the zone will minimize the amount of liquid hydrocarbons consumed in the process and permit greater liquids recovery than might otherwise be obtained. Should the accumulation of ash in the upper part of the zone tend to impede passage of the injected fluids downwardly through the zone or should there be indications that fluids are channeling through the zone, for example, the direction of flow through the rubblized zone can be reversed to alleviate such difficulties. If this is done, it will often be advantageous, at least initially, to inject the combustion air through the annulus of borehole 30, withdraw liquids through tubing string 35, and continue to take combustion gases and liquids overhead from the zone through borehole 18. Once the difficulty has been overcome, operation in the normal manner can be resumed.

The fluids withdrawn from the production borehole are passed through line 40 to a liquid-gas separator 41 where they are cooled sufficiently to condense water and the hydrocarbon liquids present and permit the recovery of heat. The gaseous components, normally consisting primarily of carbon monoxide, nitrogen, hydrogen and methane and containing smaller amounts of hydrogen sulfide, hydrogen cyanide, mercaptans, ammonia, sulfur dioxide and the like, are taken off overhead from the separator through line 42. This gas stream, which will normally have a Btu content of from about 120 to about 300 Btu's per SCF and may be somewhat similar to producer gas, may be passed through line 43 to downstream facilities for the removal of acid gases, ammonia and other contaminants and then employed as a fuel or further processed to permit the recovery of hydrogen or use of the gas for the production of synthetic liquids.

The composition of the gases obtained in carrying out the process will depend in part upon the composition of the coal in which the operation is conducted. An analysis for a typical coal in which such operations may be carried out is set forth below.

TABLE I

| Coal Analysis, Dry Basis Component | Wt. % |
|---|---|
| Fixed carbon | 45.42 |
| Carbon-Hydrogen residue | 7.67 |
| Volatile matter | 45.79 |
| Ultimate Analysis | |
| Carbon | 68.42 |
| Hydrogen | 4.92 |
| Total Sulfur | 0.75 |
| Nitrogen | 0.96 |
| Chlorine | 0.02 |
| Oxygen (difference) | 16.17 |
| Ash ($SO_3$-free) | 8.79 |
| Moisture content, wt. % as analyzed | 19.45 |
| Higher Heating value, Btu/lb. as analyzed | 9,456 |
| Higher Heating value, Btu/lb. Dry | 11,739 |
| Ash Analysis, wt. % oxides | |
| Dry ash | |
| $P_2O_5$ | 0.62 |
| $S_iO_2$ | 28.47 |
| $Fe_2O_3$ | 4.27 |
| $Al_2O_3$ | 18.49 |
| $T_iO_2$ | 1.21 |
| $C_aO$ | 20.47 |
| MgO | 5.69 |
| $SO_3$ | 20.98 |
| $K_2O$ | 0.80 |
| $Na_2O$ | 0.85 |

Laboratory tests of the process of the invention, carried out with the coal described above and using air to support combustion, resulted in a raw product gas having the composition shown below.

TABLE II

| Gas Composition Using Air Constituent | Mole % |
|---|---|
| $H_2$ | 27.27 |
| $O_2$ | 0.06 |
| $N_2$ | 42.83 |
| CO | 8.34 |
| $CO_2$ | 7.49 |
| $CH_4$ | 11.67 |
| $C_2H_4$ | 0.31 |
| $C_2H_6$ | 0.98 |
| $C_3H_6$ | 0.38 |
| $C_3H_8$ | 0.26 |
| | 99.59 |

It will be noted that the above gas contained substantial quantities of methane and $C_2$ and $C_3$ hydrocarbons. These hydrocarbons were present in the gas primarily as a result of the pyrolysis of coal in advance of the combustion front. The gas had a heating value of about 267 Btu/SCF.

It is generally advantageous to pass at least a part of the gas stream recovered from the separator through line 44 to a turbine 45 for the recovery of energy which can be used to drive the air compressors 46 employed in carrying out the operation. The low pressure gas discharged from the turbine through line 47 can then be passed to downstream processing facilities. A portion of the high pressure gas stream can also be recycled to the injection borehole through line 48 to aid in the in situ recovery process if desired.

The liquids recovered from the production borehole effluent in liquid-gas separator 41 are passed through line 49 to an oil-water separator 50. Here liquid hydrocarbons produced by pyrolysis of the coal in the rubblized zone are separated from the water present. Laboratory experiments have resulted in liquid hydrocarbon recoveries on the order of about 20 gallons per ton of dry coal and hence an operation of the type described above in a coal seam 200 feet or more thick can reasonably be expected to yield 100,000 barrels or more of hydrocarbon liquids. These liquids are recovered from separator 50 through line 51 and may be further processed by conventional methods such as hydrogenation, catalytic reforming, catalytic cracking, coking and the like to yield higher grade products.

Laboratory tests of the process carried out with the coal described earlier resulted in a liquid hydrocarbon product having the properties shown below.

TABLE III

| Properties of Hydrocarbon Liquid Product Elemental Analysis | Wt. % |
|---|---|
| C | 80.71 |
| H | 9.83 |
| S | 0.57 |
| N | 0.59 |
| Ash | 0.14 |
| $O_2$ (By difference) | 8.16 |
| | 100.00 |
| API Gravity - 13.0° | |
| Kinematic Viscosity - | 70.0 CS at 100° F.<br>33.1 CS at 210° F. |
| Distillation | |
| IBP | 122° F. |
| 10.59% | 329° F. |
| 20.65% | 376° F. |
| 30.74% | 400° F. |
| 34.58% | 434° F. |
| 44.2% | 509° F. |
| 54.43% | 557° F. |
| 55.44% | 622° F. |
| 76.02% | 681° F. |
| 83.62% | 700° F. |
| 91.84% | 1000° F. |
| Remainder | 1000+° F. |

It will be noted that the liquids recovered had a broad boiling range and included substantial quantities of relatively high boiling materials which can be upgraded into premium products by conventional refinery processes.

The water separated from the liquid stream is withdrawn through line 52 and may be stored in zone 53 for reinjection through line 54 into the injection borehole or through line 55 into the production borehole. As pointed out earlier, it is often advantageous to inject water in this fashion to cool the borehole and present damage to the tubing. Water or steam injection is also beneficial, both during the initial burning out of the cavity and during the subsequent operation in the rubblized zone, as a means for increasing the heat content of the produced gases by the reaction of steam with carbon to form hydrogen and carbon monoxide. Furthermore, the water recovered from the rubblized zone will normally contain phenols and other contaminants which will have to be removed before the water can be discharged into streams or the like. The reinjection of water reduces the amount of water for which treatment is required and also decreases the amount of water from surface sources needed to carry out the process.

Although the process of the invention has been described up to this point primarily in terms of the use of air to support combustion within the rubblized zone, it should be understood that oxygen can be employed in lieu of air if desired. The use of oxygen in place of air results in a gas stream which has a low nitrogen content and a higher Btu content than would otherwise be obtained. By introducing substantial quantities of water or steam into the top of the rubblized zone with the air or oxygen, preferably from about 2 to about 10 moles of steam per mole of oxygen, the operation can be carried out to permit the simultaneous production of liquid hydrocarbons due to pyrolysis of the coal and gasification of the char to produce a gas of moderate Btu content containing carbon monoxide, hydrogen, carbon dioxide and methane as the principal constituents. If sufficient steam is used, essentially all of the char formed by pyrolysis will be gasified, leaving solids consisting primarily of ash and containing little carbon. A typical analysis of gas produced during laboratory tests of the process of the invention, using the coal described earlier and steam and oxygen in a ratio of from 3 to 5 moles of steam per mole of oxygen, is as follows:

TABLE IV

| Gas Composition Using Steam and Oxygen | |
|---|---|
| Constituent | Mole % |
| $H_2$ | 35.5 |
| $O_2$ | 0.1 |
| $N_2$ | 1.3 |
| CO | 43.0 |
| $CO_2$ | 12.7 |
| $CH_4$ | 6.4 |
| $C_2^-$ | 1.0 |

The above gas has a heating value in excess of 300 Btu per SCF and can be employed as a fuel or upgraded by conventional acid gas removal, water-gas shift, and methanation operations. It will be noted that this gas had a somewhat lower methane content than that reported in Table II. This difference was not a result of the use of steam and oxygen in lieu of air and was due instead to the fact that the gases referred to in Table IV were recovered at a later stage in the process after most of the pyrolysis had been completed.

A further modification of the process as described up to this point involves the introduction of a hydrocarbon solvent into the upper part of the rubblized zone after the coal has been broken down and prior to establishment of the combustion front within the zone. A variety of liquid hydrocarbon solvents may be used for this purpose but it is normally preferred to employ hydrocarbon liquids boiling within the range between about 400 and about 1000° F. Particularly effective are hydrogen-donor solvents containing about 20 weight percent or more of compounds recognized as hydrogen donors at temperatures of about 700° F. and higher. Representative compounds of this type include indane, $C_{10}$–$C_{12}$ tetrahydronaphthalenes, $C_{12}$ and $C_{13}$ acenaphthalenes, di-, tetra-, and octahydroanthracenes, tetrahydroacenaphthenes, crysene, phenanthrene, pyrene, and other derivatives of partially saturated aromatic compounds. Such compounds are normally present in hydrocarbon liquids derived from coal an solvents containing them have been described in the literature and will be familiar to those skilled in the art. Such solvents are normally hydrogenated prior to their use for hydrogen donor purposes. Studies indicate that the presence of alkali metal compounds in the system may improve the action of such solvents and increase the quantity of liquids recovered.

In using a solvent for purposes of the invention, a quantity of the solvent equivalent to from about 1 to about 20% of the volume of the rubblized zone is first introduced into the system through line 56 and injected downwardly through tubing string 18 into the top of the rubblized zone. The solvent thus injected will flow downwardly in the void spaces between the coal particles and tend to form a bank in the upper part of the zone. Some solvent will be imbibed by the coal. Following injection of the solvent, a combustion front is established at the top of the rubblized zone and oxygen introduced through line 57 and water or steam from line 54 are passed downwardly through the borehole into the zone to support combustion and advance the combustion front. The reaction of steam with carbon in the coal solids behind the front results in a high hydrogen partial pressure in the system. The combustion products and volatile hydrocarbons liberated due to pyrolysis of the coal in advance of the combustion front move downwardly through the zone and in part displace the injected solvent. At relatively high rubblized zone pressures and in the presence of substantial quantities of hydrogen, liquids are extracted from the coal solids by the solvent and hence the yield of liquids in the process is increased. In addition, any solvent injected will tend to reduce the viscosity of heavy hydrocarbon liquids present in the system and thus further aid liquids recovery from the bottom of the rubblized zone.

Liquids recovery operations carried out without the injection of substantial quantities of steam will normally result in the formation of char solids within the rubblized zone. After the liquids recovery in such an operation is substantially completed, these solids can be gasified to permit the recovery of additional hydrocarbons and gases and leave behind solids which consist primarily of ash. In laboratory experiments involving liquids recovery followed by gasification, the remaining residue normally had an ash content of about 95% by weight. In carrying out such a subsequent gasification operation, it is generally preferred to convert the production borehole to an injection borehole and alter the earlier injection borehole to permit its use for production purposes as illustrated in FIG. 4 of the drawing.

Figure 4:
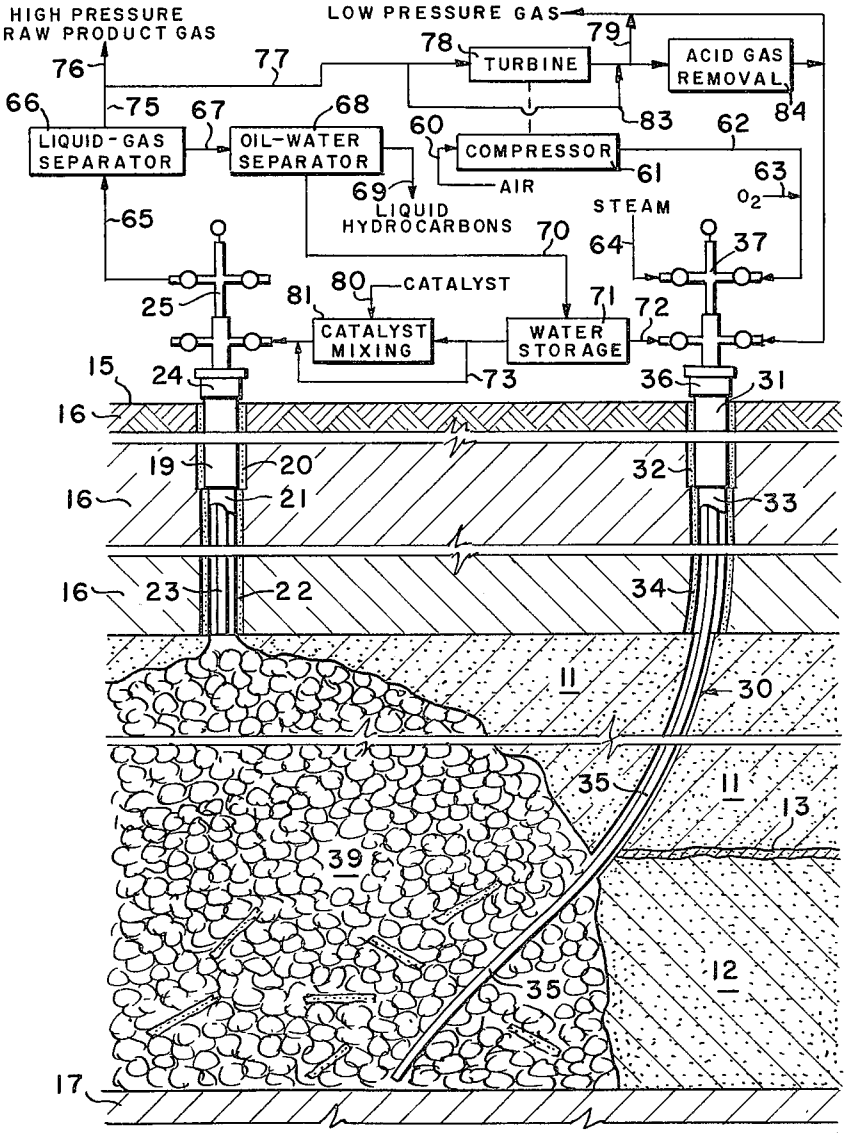
FIG. 4 is a schematic diagram of the underground seam of FIGS. 1 through 3 and the associated surface facilities during a gasification operation carried out subsequent to the recovery of coal liquids in accordance with the invention.

The gasification operation depicted in FIG. 4 of the drawing is carried out by injecting air introduced into the system through line 60, compressor 61 and line 62, oxygen introduced through line 63, or a mixture of the two, downwardly into the bottom of the rubblized zone 39 through tubing string 35. As a result of the earlier liquids recovery operation, the temperature at the bottom of the zone may be sufficiently high to effect ignition of the char and any remaining liquids spontaneously. If such is not the case, an electrical igniter lowered through tubing string 35 or other means described earlier may be employed to initiate combustion at the bottom of the zone. After combustion has been established, steam introduced into the system through line 64 is passed downwardly through tubing string 35 along with the air or oxygen to effect the gasification of carbon and the production of hydrogen and carbon monoxide by the steam-carbon reaction. The amount of oxygen supplied, either as air, oxygen-enriched air, or pure oxygen, must be sufficient to heat the coal solids within the rubblized zone to gasification temperatures and supply the endothermic heat of reaction required. The ratio of steam to air or oxygen will therefore depend in part upon the temperatures at which the steam and air or oxygen are injected, the amount of heat retained by the solids within the rubblized zone, the composition of the solids and any liquids remaining in the zone, the pressure within the rubblized zone, and other factors. In general, steam-to-oxygen ratios between about 1:1 and about 20:1 may be employed. Ratios between about 2:1 and about 10:1 are generally preferred. The use of insufficient oxygen will normally result in low gasification rates and the production of relatively little hydrogen and carbon monoxide. The use of excess oxygen will generally result in a gas stream containing carbon dioxide in relatively high concentrations. The optimum ratio for a particular operation can generally be determined without undue difficulty by monitoring the composition of the gases produced during the operation and adjusting the ratio to maximize the hydrogen and carbon monoxide content. Optimum steam and air or oxygen injection rates can normally be determined in a similar manner by observing the pressure behavior at the injection and production boreholes.

The gases produced by the reaction of steam and oxygen with the char solids in the rubblized zone will contain hydrogen, carbon monoxide, carbon dioxide, methane, unreacted steam, hydrogen sulfide, ammonia, hydrogen cyanide, and the like. If air is employed to supply the needed oxygen, substantial quantities of nitrogen will also be present. The use of gaseous oxygen in lieu of air results in a raw product gas with a higher heating value and simplifies the downstream processing steps required. The gases produced are withdrawn from the top of the rubblized zone through tubing string 23 or, if desired, through both the tubing string and the surrounding annulus. The tubing string is not essential during this phase of the operation and may in some cases be withdrawn. It is generally preferred, however, to leave the tubing string in place and cool the production borehole by the introduction of limited quantities of water down the annulus.

The gases withdrawn from the production borehole 18 are passed through line 65 to a conventional liquid-gas separator 66 where heat is recovered from the gas stream and the gases are cooled sufficiently to condense out water and normally liquid hydrocarbons. The liquids stream thus obtained is passed through line 67 to oil-water separator 68 where the hydrocarbons are recovered as indicated by reference numeral 69. The water produced flows through line 70 to water storage zone 71. Water from this zone can be injected through line 72 into injection borehole 30 to provide cooling and additional steam. Water may be passed through line 73 to the production borehole 18 and used for cooling purposes. Although not shown specifically in the drawing, water from zone 71 can also be employed in many cases to provide the steam injected into the system through line 64. This use of the water for steam generation purposes will normally require conventional water treating measures before the water is supplied to the steam generators. By reusing the water in this fashion, the demand for water from external sources is reduced and the water treating requirements to avoid potential pollution problems may be alleviated.

The gas stream recovered from liquid-gas separator 66 is taken overhead from the separator through line 75. This gas may be passed through line 76 to downstream processing facilities for the recovery of hydrogen, upgrading into a fuel gas of higher Btu content, or use in liquid hydrocarbon synthesis processes such as the Fischer-Tropsch process. Alternatively, all or part of the produced gas may be passed through line 77 and turbine 78 for the recovery of energy from the gas stream before it is withdrawn through line 79 for storage or further processing. By using the turbine to drive air compressors employed in the process, the overall operating costs can often be significantly reduced. If oxygen is employed in lieu of air, the amount of compression necessary will generally be substantially less and hence other systems may be used for the recovery of energy from the product gases.

There are numerous modifications which may be made in the gasification operation described above without departing from the invention. Although it is normally preferred to conduct the gasification operation in an upflow manner as described, a downflow type of operation can instead be employed if desired. The steam and oxygen employed can in some cases be injected alternately instead of simultaneously. In addition, gasification catalysts can be used to accelerate the gasification rate during the gasification stage of the process. As pointed out earlier, potassium carbonate, sodium carbonate, cesium carbonate, calcium carbonate and a variety of other alkali metal and alkaline earth metal compounds have been shown to catalyze the steam-carbon reaction and thus make possible higher gasification rates or lower reaction temperatures than would otherwise be the case. If such a catalyst is to be used and has not been supplied earlier, it will normally be added to the system prior to initiation of the gasification operation. This can be done following the liquids recovery operation by preparing an aqueous solution of potassium carbonate or a similar water soluble alkali metal or alkaline earth metal compound introduced through line 80 in catalyst mixing zone 81 and then injecting the resultant solution into the rubblized zone through borehole 18. The amount of catalyst employed will generally range between about 0.1 and about 20% by weight, based upon the amount of carbon present in the rubblized zone. Introduction of the catalyst solution will result in the addition of a substantial amount of water into the zone but this will be vaporized and converted to steam as the gasification operation proceeds. By employing a gasification catalyst to accelerate the steam gasification rate, the duration of the gasification operation can be reduced and hence in many cases the overall cost of the process can be decreased. If desired, a substantial portion of the alkali metal or alkaline earth metal compound employed as the gasification catalyst can be recovered following the gasification operation by circulating water or an aqueous solution of sulfuric acid, formic acid or the like through the rubblized zone to leach out the potassium or other alkali metal constituent.

The use of carbon-alkali metal catalysts to catalyze the gasification operation is particularly advantageous. Extensive studies have shown that potassium, lithium, sodium and cesium compounds intimately mixed with carbonaceous solids undergo a reaction with the carbon to form alkali metal compounds or complexes and that these reaction products not only catalyze the steam-carbon reaction but also result in equilibrium of the gas phase reactions involving carbon, hydrogen and oxygen compounds in such a system. This equilibrium, which is not normally obtained with alkaline earth metal compounds, is of significant importance because it makes possible control of the operating conditions to emphasize, for example, the production of methane and carbon dioxide in lieu of hydrogen and carbon monoxide. If a catalyst of this type is to be employed, it will often be advantageous to inject the alkali metal compound solution, an aqueous potassium carbonate solution for example, into the upper part of the rubblized zone through wellbore 18 in a quantity sufficient to permit impregnation or imbibition of the solution into the carbonaceous solids in at least the upper part of the zone and preferably over substantially the entire zone before commencing the gasification operation.

After the alkali metal solution has been injected, combustion can be initiated in the upper part of the zone and air or oxygen can be supplied through borehole 18 to sustain combustion and heat the solids in at least the upper part of the zone to high temperatures on the order of 800° to 1200° F. or more. At these high temperatures, the alkali metal constituents will react with the carbon to form the carbon-alkali metal catalyst. The combustion products obtained can be withdrawn from the lower end of the rubblized zone through borehole 30. After sufficient air or oxygen to heat the solids in the upper part of the solids in the upper part of the zone to the requisite high temperatures has been injected, this stage of the operation can be terminated and the surface facilities can be modified as shown in FIG. 4 to permit carrying out of the gasification operation. During subsequent gasification of the carbonaceous solids in the rubblized zone, the gases in the upper portion of the zone will contact the carbon-alkali metal catalyst produced earlier and the gas phase reactions will tend to be in equilibrium. High pressure within the rubblized zone, particularly pressures on the order of 500 to 2000 psi or higher, will tend to promote the formation of methane and carbon dioxide in lieu of hydrogen and carbon monoxide and hence a higher Btu content gas than might otherwise be obtained will normally be produced. Because the carbon-alkali metal catalyst is also a gasification catalyst, the oxygen content of the gases introduced into the bottom of the rubblized zone can be reduced to lower the temperature in the rubblized zone and thus further favor the production of methane as opposed to hydrogen and carbon monoxide. If desired, a portion of the gas produced can, after removal of the liquids, be passed through lines 77 and 83 to an acid gas removal unit 84 for the removal of carbon dioxide, hydrogen sulfide and the like. This gas will contain hydrogen and carbon monoxide in higher concentrations than the produced gas and its reinjection into the rubblized zone will tend to shift the equilibrium further toward the production of methane and carbon dioxide. Moreover, if desired, the entire gas stream withdrawn from the rubblized zone can be processed for the removal of acid gases and subsequent recovery of the methane present, leaving a gas stream consisting primarily of hydrogen and carbon monoxide which can be recycled to further aid in shifting the equilibrium. In such an operation, the primary product from the gasification stage of the process will be methane which can be employed as a pipeline gas without substantial further processing.

Figure 5:
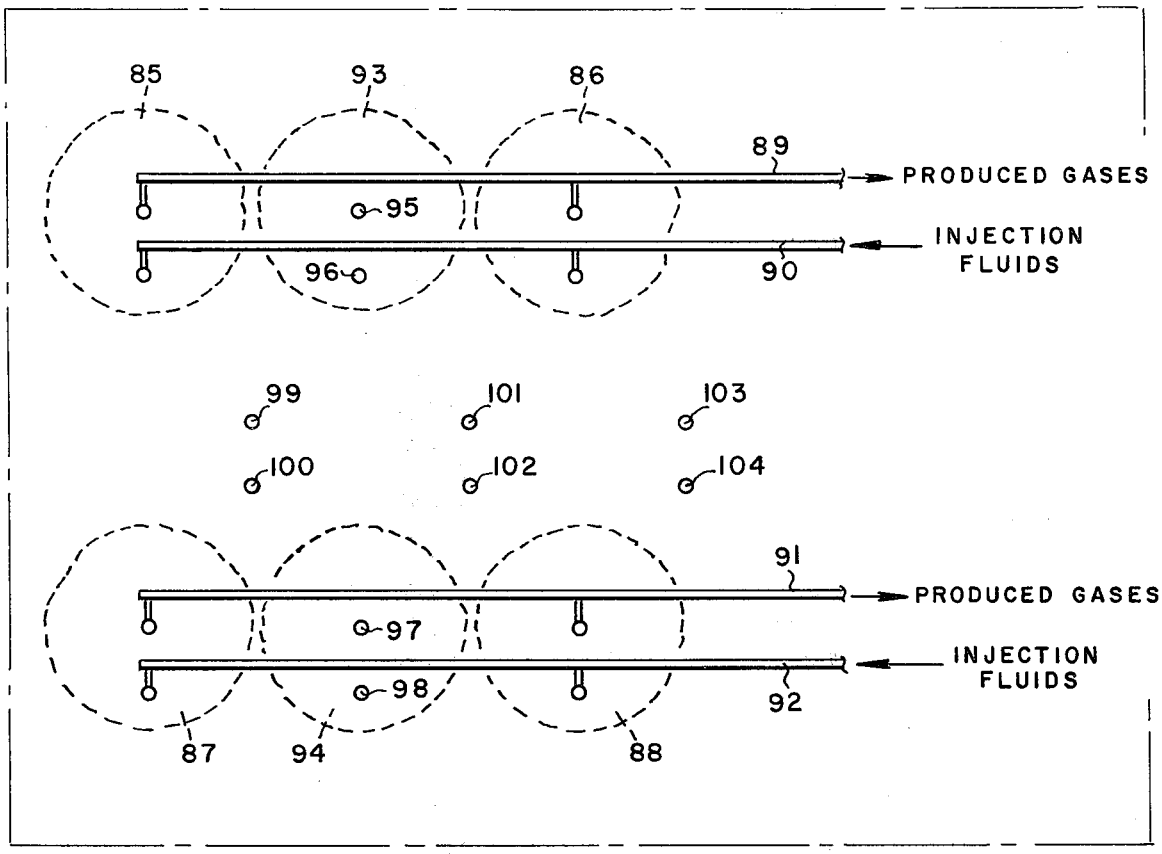
FIG. 5 is a plan view illustrating one embodiment of the process of the invention.

The process of the invention is described above in terms of a single rubblized zone but it will be apparent that operations can be carried out in two or more such zones simultaneously. FIG. 5 in the drawing is a plan view of an area overlying a thick, deep coal seam in which multiple rubblized zones have been formed as described above. In this operation, reference numerals 85, 86, 87 and 88 indicate underground rubblized zones in which liquids recovery operations have been completed and gasification operations are in progress. Each of these rubblized zones include a central borehole and an offset borehole similar to those illustrated in FIGS. 1 through 4. The central boreholes of rubblized zones 85 and 86 are tied to a product gas manifold 89 which extends to gas separation and processing facilities not shown in FIG. 5. Similarly, the injection wells in these rubblized zones are tied to an injection manifold 90 which extends from injection fluid facilities not shown. The injection and production boreholes in rubblized zones 87 and 88 are similarly manifolded by means of lines 91 and 92. Operations in these four rubblized zones are being carried out simultaneously. References numerals 93 and 94 indicate rubblized zones which have previously been subjected to liquids recovery and gasification operations through boreholes 95, 96, 97 and 98. Upon completion of these operations, the rubblized zones were filled with a slurry of slag, sand, waste or other solids to prevent subsidence and support the surrounding coal. The boreholes were then plugged so that the operations in rubblized zones 85, 86, 87 and 88 could be carried out. If desired, a sealing agent such as a plastic or resin solution can be used to seal the walls of the burned out zone before plugging the boreholes. It will be noted that the two rows of rubblized zones are separated by an area sufficiently wide to permit the creation of additional rubblized zones between them. Boreholes 99, 100, 101, 102, 103 and 104 have been drilled to permit the development of additional rubblized zones as the operations continue. This development of multiple rubblized zones using common surface facilities and if necessary the use of waste solids to fill in rubblized zones after the liquids recovery and gasification operations have been carried out makes possible the recovery of hydrocarbons from a high percentage of the coal present in the seam and permits economies of operation that might otherwise be difficult to obtain.

We claim:

1. A process for the recovery of liquid hydrocarbons from a thick underground coal deposit which comprises drilling at least one borehole into the lower portion of said coal deposit from the earth's surface, burning out the coal near the bottom of said deposit over a limited area in the vicinity of said borehole to form a cavity having a volume equivalent to from about 5 to about 30% of the coal within said deposit overlying said limited area, breaking down the coal overlying said cavity to form a rubblized zone extending vertically in said deposit to a point near the upper boundary of the deposit, establishing a flame front within said rubblized zone, driving said flame front vertically through said zone, and withdrawing liquids and gases from said rubblized zone.

2. A process as defined by claim 1 wherein said coal is a noncaking coal.

3. A process as defined by claim 1 wherein said coal is a caking coal and is treated with an alkali metal or alkaline earth metal compound before said flame front is driven through said rubblized zone.

4. A process as defined by claim 1 wherein said coal deposit includes multiple seams.

5. A process as defined by claim 1 wherein said flame front is driven downwardly through said rubblized zone by injecting a combustion-supporting gas into the upper portion of said zone and withdrawing said liquids and gas from said zone at a point near the bottom of said zone.

6. A process as defined by claim 1 wherein said cavity extends over a horizontal area near the bottom of said deposit of from about one-fourth to about two acres.

7. A process as defined by claim 1 wherein said flame front is driven through said rubblized zone by introducing steam and an oxygen-containing gas into said zone behind the flame front.

8. A process as defined by claim 1 wherein said coal is broken down into said cavity by fracturing.

9. A process as defined by claim 1 wherein said coal is broken down into said cavity by means of explosives.

10. A process as defined by claim 1 wherein said coal within said rubblized zone is treated with a solution of an alkali metal compound prior to the establishment of said flame front within said zone.

11. A process as defined by claim 1 wherein a hydrocarbon solvent is introduced into said rubblized zone prior to the establishment of said flame front within said zone.

12. A process as defined by claim 1 wherein said rubblized zone extends vertically in said coal deposit over a distance of from about 50 to about 1000 feet.

13. A process as defined by claim 1 wherein liquids and gases are withdrawn from said rubblized zone until the quantity of liquid hydrocarbons being produced substantially decreases, the injection of gases into said rubblized zone is then terminated, steam and oxygen are thereafter injected into said rubblized zone, and gases are again withdrawn from said rubblized zone.

14. A process as defined by claim 1 wherein said flame front is driven downwardly through said rubblized zone by injecting steam and oxygen into said zone behind the flame front in a steam-to-oxygen ratio of from about 2:1 to about 10:1.

15. A process as defined by claim 1 wherein said coal in said rubblized zone is treated with a solution of potassium carbonate prior to the establishment of said flame front.

16. A process for the recovery of liquid hydrocarbons from an underground coal deposit having a thickness of from about 50 to about 1000 feet or more which comprises drilling at least two boreholes into the lower portion of said coal deposit from the earth's surface; establishing communication between said boreholes within said coal deposit near the lower boundary of said deposit; initiating combustion of said coal near the lower boundary of said deposit through one of said boreholes; introducing an oxygen-containing gas into said deposit through one of said boreholes and withdrawing gaseous combustion products from said deposit through another of said boreholes until a cavity has been burned out between said boreholes near the lower boundary of said deposit, said cavity having a volume equivalent to from about 5 to about 30% of the coal overlying an area of from about one-fourth to about two acres in the vicinity of said boreholes near the lower boundary of said deposit; breaking down into said cavity the coal overlying said cavity until a rubblized zone extending vertically to a point near the upper boundary of said deposit has been formed; igniting said coal in said rubblized zone at a point near the upper end of said zone; injecting an oxygen-containing gas downwardly into the upper part of said rubblized zone through one of said boreholes and withdrawing fluids from the lower part of said rubblized zone through another of said boreholes; and recovering hydrocarbon liquids from said fluids.

17. A process as defined by claim 16 wherein said coal is broken down into said cavity by detonating a series or explosive charges in at least one of said boreholes at points above said cavity.

18. A process as defined by claim 16 wherein steam is introduced into said deposit with said oxygen-containing gas during the burning out of said cavity.

19. A process as defined by claim 16 wherein said coal is broken down into said cavity by injecting a fracturing fluid into the coal above said cavity from at least one of said boreholes.

20. A process as defined by claim 19 wherein said fracturing fluid comprises an explosive fracturing fluid.

21. A process as defined by claim 16 wherein said communication between said boreholes is established by injecting a fluid from one of said boreholes into said coal at a pressure sufficient to fracture the coal.

22. A process as defined by claim 16 wherein said coal is a caking coal and a solution of an alkali metal compound is injected into said coal prior to igniting said coal in said rubblized zone.

23. A process as defined by claim 22 wherein said alkali metal compound is an alkali metal carbonate.

24. A process as defined by claim 16 wherein steam is injected downwardly into said upper part of said rubblized zone at the same time said oxygen-containing gas is injected downwardly into said upper part of said rubblized zone.

25. A process as defined by claim 24 wherein said steam and said oxygen-containing gas are injected into said rubblized zone at a steam-to-oxygen ratio of from about 2:1 to about 10:1.

26. A process as defined by claim 16 wherein a solvent boiling between about 400° and about 1000° F. is injected into the upper part of said rubblized zone prior to igniting said coal in said rubblized zone.

27. A process as defined by claim 26 wherein said solvent is a hydrogen-donor solvent and is injected in a quantity equivalent to from about 1 to about 20% of the volume of said rubblized zone.

28. A process as defined by claim 16 including the additional steps of terminating the injection of said oxygen-containing gas and the withdrawal of said fluids from said rubblized zone after the hydrocarbon liquids content of the fluids being withdrawn has declined substantially, establishing combustion within said rubblized zone near the bottom of said zone, and injecting steam and an oxyen-containing gas into the lower part of said rubblized zone through one of said boreholes and withdrawing gases from the upper part of said rubblized zone through another of said boreholes.

29. A process as defined by claim 28 wherein said oxygen-containing gas injected with said steam is substantially pure oxygen.

30. A process as defined by claim 28 including the additional step of injecting a solution of an alkali metal compound into said rubblized zone after said injection of said oxygen-containing gas and said withdrawal of said fluids has been terminated and before combustion is established within said rubblized zone near the botton of said zone.

31. A process as defined by claim 30 wherein said alkali metal compound is potassium carbonate.

32. A process as defined by claim 30 including the additional steps of initiating combustion in the upper part of said rubblized zone after said solution of said alkali metal compound has been injected into the upper part of said zone, injecting an oxygen-containing gas into said zone and withdrawing combustion products from said zone to heat the solids in said upper part of said zone to a temperature on the order of from 800° to 1200° F., and terminating said injection of said oxygen-containing gas and said withdrawal of said combustion product before combustion is established within said rubblized zone near the bottom of said zone.

33. A process as defined by claim 16 wherein water is recovered from said fluids and recycled to said rubblized zone.

* * * * *